US007429164B2

(12) United States Patent
Yamashita et al.

(10) Patent No.: US 7,429,164 B2
(45) Date of Patent: Sep. 30, 2008

(54) TURBINE MOVING BLADE

(75) Inventors: Yutaka Yamashita, Hitachi (JP); Kiyoshi Namura, Tokai (JP); Eiji Saitou, Hitachi (JP); Masakazu Takasumi, Hitachi (JP); Masato Machida, Hitachi (JP); Hideo Yoda, Hitachi (JP); Kazuo Ikeuchi, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 44 days.

(21) Appl. No.: 10/524,834

(22) PCT Filed: Sep. 2, 2002

(86) PCT No.: PCT/JP02/08869

§ 371 (c)(1),
(2), (4) Date: Sep. 13, 2005

(87) PCT Pub. No.: WO2004/022923

PCT Pub. Date: Mar. 18, 2004

(65) Prior Publication Data

US 2006/0127221 A1 Jun. 15, 2006

(51) Int. Cl.
*F01D 5/26* (2006.01)

(52) U.S. Cl. ..... 416/190; 416/222

(58) Field of Classification Search ..... 416/189, 416/190, 191, 194, 195, 196 R, 222, 248
See application file for complete search history.

(56) References Cited

U.S. PATENT DOCUMENTS 5,211,540 A * 5/1993 Evans ..... 416/190
5,829,955 A * 11/1998 Saito et al. ..... 416/191
6,283,713 B1 * 9/2001 Harvey et al. ..... 416/193 A
6,341,941 B1 1/2002 Namura et al.

FOREIGN PATENT DOCUMENTS

| | | |
|---|---|---|
| JP | 03-179106 | 8/1991 |
| JP | 05-098906 | 4/1993 |
| JP | 10-008905 | 1/1998 |
| JP | 10-176501 | 6/1998 |
| JP | 10-299405 | 11/1998 |
| JP | 11-013401 | 1/1999 |
| JP | 11-081905 | 3/1999 |
| JP | 11-159302 | 6/1999 |

OTHER PUBLICATIONS

Nuemann et al. article, "Thirty Years Experience with Integrally Shrouded Blades"; 1989; pp. 1-8.

* cited by examiner

*Primary Examiner*—Richard Edgar
(74) *Attorney, Agent, or Firm*—Mattingly, Stanger, Malur & Brundidge, P.C.

(57) ABSTRACT

A turbine moving blade has a blade portion extending from the basal portion to the tip of the moving blade. The blade root portion is formed at the basal portion of the blade portion and engaged with a corresponding disk groove of a turbine rotor on a one-by-one basis, and the integral cover is formed at the tip of the blade portion integrally with the blade portion. The integral cover includes at least a pair of pressure and suction sloped surfaces inclined relative to the direction of the rotational axis of a turbine so as to restrain the elastic restoring force of the moving blade torsionally deformed at the time of installation of the moving blade by bringing the integral covers of mutually adjacent blades into contact.

8 Claims, 7 Drawing Sheets

TURBINE MOVING BLADE

TECHNICAL FIELD

The present invention relates to a turbine moving blade having an integral cover at the tip of the blade.

BACKGROUND ART

Structures for connecting mutually adjacent turbine moving blades include an integral cover-blade structure that has connection covers (integral covers) integrally formed with blades and extending in a circumferential direction on the suction and pressure sides of the blades, and that connects blades by bringing the integral covers on the suction and pressure sides of mutually adjacent blades into contact. Such a blade connection structure has advantages in that the integral covers formed integrally with blades offers a superior resistance (strength) to centrifugal force and the like, and that friction at contact-connecting portions between integral covers provides a large vibration attenuation, thereby allowing a high-reliability blade connection structure to be provided.

An example of a conventional art of a turbine moving blade having an integral cover at the tip of blade is disclosed in Japanese Unexamined Patent Application Publication No. 5-98906. This patent document set forth a structure wherein the integral cover has a pair of suction and pressure sloped side-surfaces inclined relative to the direction of the rotational axis of a turbine, wherein the circumferential pitch of the suction and pressure side surfaces is made larger than the pitch that is obtained by dividing the circumference at a radial position of cover installation by the number of blades over the entire circumference (hereinafter, the latter pitch is referred to as a "geometric pitch"), and wherein the blades are torsionally deformed by being pressed along the circumferential direction of the turbine for assembly, thereby restraining a reaction force against it to strongly connect mutually adjacent blades.

When assembling blades having these integral covers by pressing the blades along the circumferential direction, since the pitch of the covers in the circumferential direction is made larger than the geometric pitch, a reaction force inevitably occurs in the covers. As a result, the blade located at the end position of the train of blades in the process of being assembled (hereinafter, such a blade is referred to as an "end blade") is subjected to a reaction force only on either one of the suction sloped surface and pressure sloped surface. Hence, the end blade attempts to leave an adjacent blade in the direction away from the adjacent blade, that is, in a manner such that the circumferential component of the reaction force acting on the contact surface becomes weak. This makes the assembly of the blades difficult. In particular, for the blade having high stiffness and small blade length, the reaction force acting along the circumferential direction is large, and therefore, when only the blade root is fixed by friction between a blade root hook and a disk groove, the suction and pressure sloped surfaces of the integral cover of an end blade, respectively located on the suction and pressure sides of adjacent blades, are subjected to forced displacement, resulting in bending deformation of the blade. Consequently, a high stress acts on the basal portion between the cover portion and blade portion. In addition, due to a circumferential force component corresponding to the bending deformation, the blades are bending-deformed in the direction opposite to the direction to assemble blade. This not only makes the assembling of blades difficult but also produces nonuniform contact between the blade root hook and disk groove, thereby causing a high stress therebetween. The blade root hooks and disk grooves support large centrifugal forces acting on the blades during rotation of the turbine. Therefore, when the turbine is rotated at a high speed with a high stress acted on at the time of assembling, strength problem might occur.

Accordingly, the object of this invention is to provide a turbine moving blade capable of being easily assembled, reducing a stress produced at the basal portion between an integral cover and a blade portion, and suppressing nonuniform contact of the engagement portion between the blade root portion and the disk.

DISCLOSURE OF INVENTION

To achieve the above-described object, the turbine blade according to this invention is a turbine moving blade formed so as to restrain the elastic restoring force of the blades torsionally deformed at the time of installation of the moving blade by bringing the integral covers of mutually adjacent blades into contact. This integral cover is formed so that, as viewed from a radial direction, the normal of the suction sloped surface passing through the mid point on the contact surface on the suction sloped surface in the direction of the sloped surface and orthogonally intersecting the sloped surface does not cross the blade portions.

Specifically, the turbine blade according to this invention includes a blade portion extending from the basal portion to the tip of the moving blade, a blade root portion formed at the basal portion of the blade portion and engaged with a corresponding disk groove of a turbine rotor on a one-by-one basis, and an integral cover formed at the tip of the blade portion integrally with the blade portion. Herein, the integral cover includes at least a pair of pressure and suction sloped surfaces inclined relative to the direction of the rotational axis of a turbine so as to restrain the elastic restoring force of the blades torsionally deformed at the time of installation of the moving blade by bringing the integral covers of mutually adjacent blades into contact. This integral cover is formed so that, as viewed from a radial direction, the normal of the suction sloped surface passing through the mid point on the contact surface on the suction sloped surface in the direction of the sloped surface and orthogonally intersecting the sloped surface does not cross the blade portion.

BEST MODE FOR CARRYING OUT THE INVENTION

Hereinafter, embodiments according to the present invention will be described with reference to the drawings.

Figure 1:
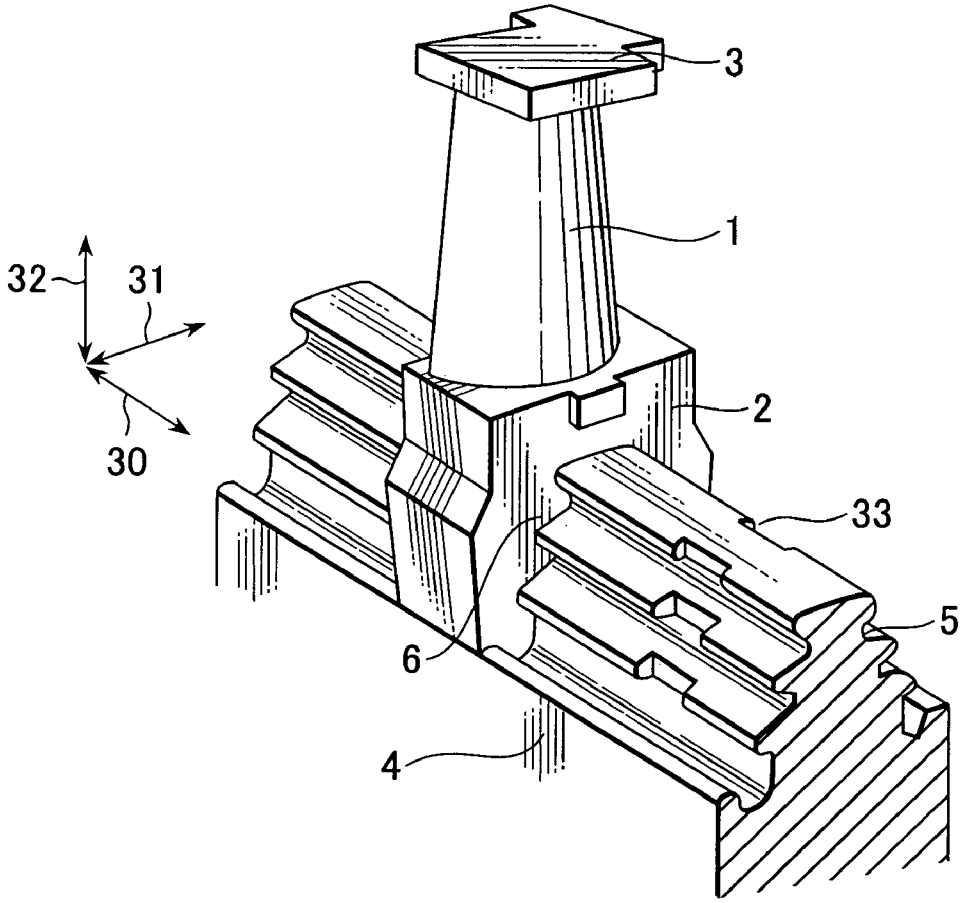
FIG. 1 is a perspective view of a blade structure according to a first embodiment of the present invention.
Figure 2:
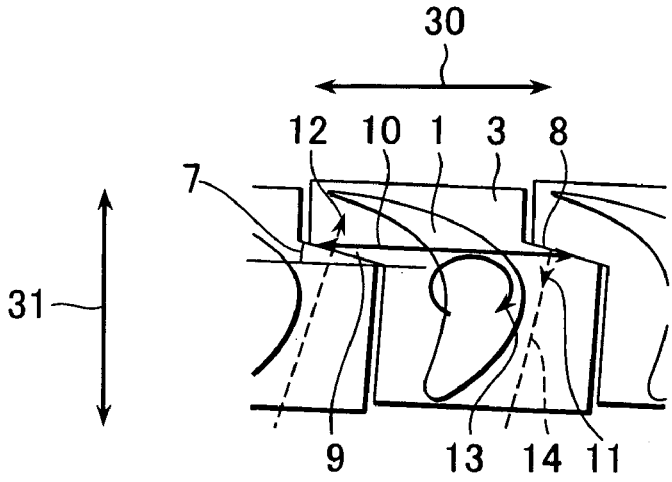
FIG. 2 is a plan view of one blade cover as seen from the radial direction.

FIG. 1 is a perspective view of a blade structure according to a first embodiment of the present invention, and FIG. 2 is a plan view of an integral cover as seen from the outer peripheral side in the radial direction. The turbine moving blade includes a blade profile portion 1, a blade root portion 2 formed at the basal portion of the blade profile portion 1, and an integral cover 3 formed at the tip of the blade integrally with the blade profile portion. The turbine moving blade formed in this manner is inserted, from the radial direction, into a notch portion 33 of a disk groove 5 provided in the outer periphery of the disk 4, and after having been engaged with a blade root hook 6 formed at the blade root portion 2, the turbine moving blade is assembled by being slid in the circumferential direction on a one-by-one basis.

Next, the shape of the integral cover 3 will be described with reference to FIG. 2. In FIG. 2, the integral cover 3 is sectioned along the circumferential direction 30, and has a suction sloped surface 8 and a pressure sloped surface 9 that are formed at an inclination angle 7 that is a positive acute angle when measured clockwise from the circumferential direction 30. The circumferential pitch 10 of the suction sloped surface 8 and pressure sloped surface 9 is made a little larger than the geometric pitch. Here, the mutually adjacent blades are configured so that the suction sloped surface 8 of one of the blades and the pressure sloped surface 9 of the other of the blades contact each other. The inclination angle 7 is set up so that, as seeing the integral cover 3 from the outer peripheral side in the radial direction, a perpendicular 14 passing through the mid point on the contact surface on the suction sloped surface and orthogonally intersecting the sloped surface does not cross the blade profile portion 1 having the sloped surfaces 8 and 9.

More specifically, letting the normal extended toward the outside of the surface of the integral cover 3 be an outward normal, and letting the normal extended toward the inside of the surface of the integral cover 3 be an inward normal, in this illustrated embodiment, the suction sloped surface 8 constituting the contact surface with an integral shroud portion of an adjacent blade is formed so that, inside the integral cover 3, the inward normal extended toward the upstream side of the turbine axial direction 31 does not cross the blade profile portion 1.

Now, force and moment generated in the cover portion of the moving blade having such an integral cover will be described with reference in FIG. 2. When moving blades are engaged with disk grooves one after another, and are assembled by being slid along the circumferential direction, since the circumferential pitch 10 is made larger than the geometric pitch 10, pressing the blades along the circumferential direction brings the suction sloped surfaces 8 and the pressure sloped surfaces 9 into contact with the sloped surfaces of adjacent blades. A vertical force 11 with respect to the suction sloped surface 8 and a vertical force 12 with respect to the pressure sloped surface act on the each of the integral covers 3. Due to this couple force, a torsional moment acts on the integral cover 3 and torsionally deforms the blade portion. The elastic restoring force generated by this torsional deformation of the blade causes the contact surface between the suction sloped surface 8 and the pressure sloped surface 9 to produce a reaction force, thereby achieving the connection between mutually adjacent blades.

Figure 3:
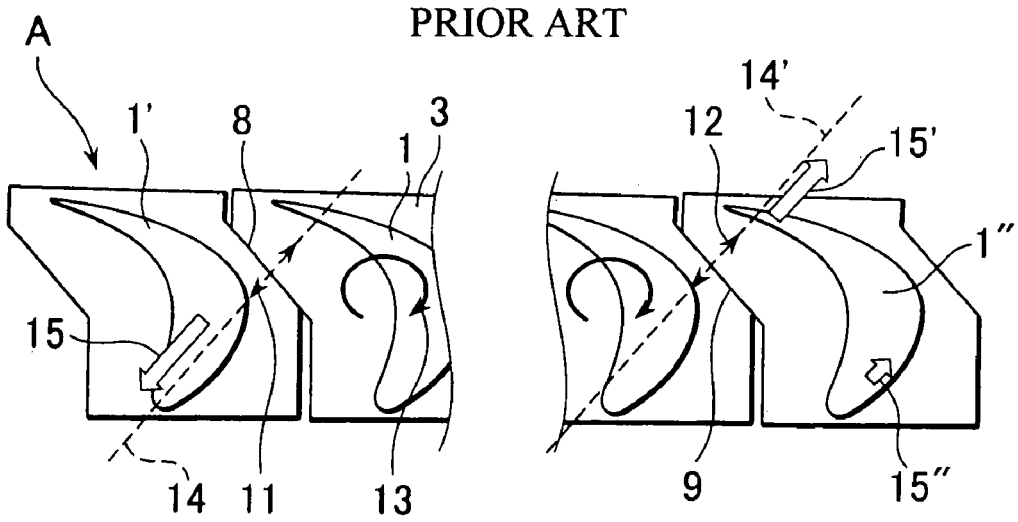
FIG. 3 PRIOR ART
FIG. 3 is a plan view of conventional blade covers as seen from the radial direction.

Here, a conventional integral cover will be explained with reference to FIG. 3. FIG. 3 is a plan view of the integral cover as seen from the radial direction. The structure illustrated in FIG. 3 is a structure that is formed so that, as seen from the outer peripheral side in the radial direction, the inward normal passing through the mid point on the contact surface on the suction sloped surface 8 and orthogonally intersecting the sloped surface, crosses the profile of the blade 1 having the sloped surface. When assembling turbine blades by sliding them in the circumferential direction one after another, in the integral cover 3 of an end blade 1' located on the pressure side of an adjacent blade in the process of being assembled, the suction sloped surface 8 is given a forced displacement in the vertical direction relative to the suction sloped surface 8. As a result, the blade attempts to bending-deform. Here, an extension line of the vertical force 11 with respect to the sloped surface, generated in corresponding with an elastic restoring force of the blade, that is, the perpendicular 14 passing through the mid point on the contact surface on the sloped surface as seen from the radial direction, crosses the blade profile portion. Thereby, the end blade 1' is significantly bending-deformed, and in addition, a component of the bending deformation occurs also in the circumferential direction 30.

Figure 4:
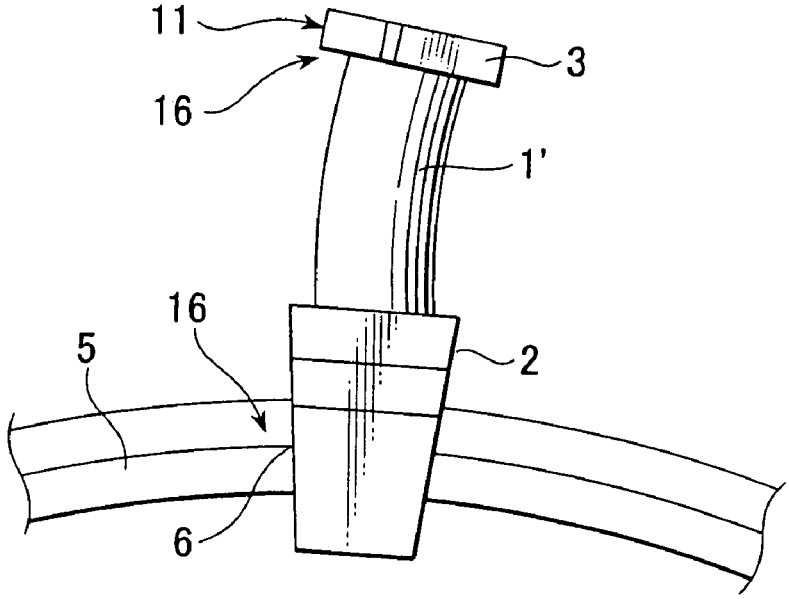
FIG. 4 PRIOR ART
FIG. 4 is a schematic view showing a bending-deformed state of an end blade on the pressure side of the adjacent blade in a conventional adjacent blade.

FIG. 4 is a schematic view showing a bending-deformed state of the end blade 1' as seen from the arrow "A" direction in FIG. 3. When the blade is deformed in the circumferential direction at the time of assembling, a force works in the direction opposite to the direction of inserting the blade. This might interfere with the assembly, as well as generate a high stress 16 in the integral cover 3 and the basal portion of the end blade, and also produce a nonuniform contact at the engagement portion between the disk groove 5 and the blade root hook 6, thereby generate a high stress. If, in a state where the end blade 1' has undergone a bending deformation, next blades are inserted along the circumferential direction, blades inserted after the end blade 1' might be also assembled in a state of remaining bending-deformed. The disk grooves 5 and the blade root hooks 6 support centrifugal force acting on the blades during the rotation of the turbine. Therefore, when the turbine rotated at the high speed with a high stress acted on the engagement portion between the disk groove 5 and the blade root hook 6 at the time of assembling, the stress further increases during rotation. This might pose strength problem.

Figure 5:
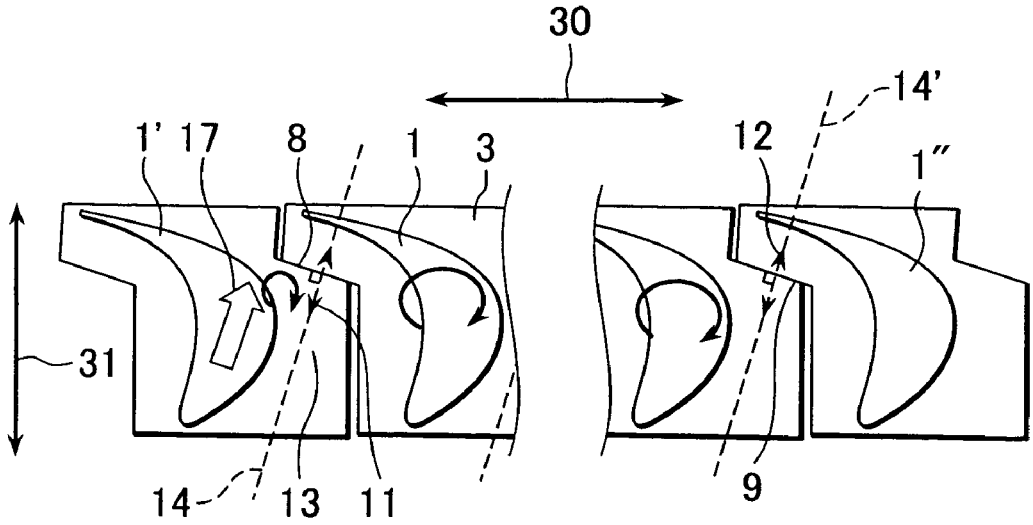
FIG. 5 is a plan view of a plurality of blade covers according to the first embodiment of the present invention as seen from the radial direction.

FIG. 5 is a plan view of integral covers of the turbine moving blades incorporated in the present invention, as seen from the outer peripheral side in the radial direction. When assembling turbine blades by sliding them in the circumferential direction one after another, in the integral cover 3 of the end blade 1' located on the pressure side of an adjacent blade in the process of being assembled, the suction sloped surface 8 is given a forced displacement in the vertical direction relative to the sloped surface. As a result, the blade attempts to bending-deform. In this embodiment, however, an extension line of the vertical force 12 relative to the sloped surface, generated in correspondence with an elastic restoring force of the blade, that is, the perpendicular 14 passing through the mid point on the contact surface on the suction sloped surface 8 and orthogonally intersecting the sloped surface as seen from the radial direction, does not cross the blade profile portion. Thereby, a couple force acts on the integral cover 3 due to the vertical force with respect to the sloped surface and an elastic restoring force 17 of the blade, thereby torsionally deforming the end blade 1'.

Specifically, the forced displacement in the vertical direction relative to the suction sloped surface 8, which has been given to the suction sloped surface 8, is discomposed into the torsional deformation and bending deformation of the blade, and the bending deformation of the end blade 1' becomes small. This allows circumferential bending generated in the blade at the time of assembling to be reduces, and inhibits the occurrence of nonuniform contact between the blade root hook 6 and the disk groove at the time of assembling, thereby preventing a large stress from occurring. As a result, it is possible to provide a turbine blade capable of being easily assembled and having high reliability.

In the integral cover 3 of an end blade 1" located on the pressure side of an adjacent blade, the pressure sloped surface 9 is given a forced displacement in the vertical direction relative to the sloped surface, but the trailing edge of the blade is low in stiffness and the blade undergoes a torsional deformation, thereby presenting no problem.

If the rotational direction of turbine moving blade is opposite to that of the turbine moving blade described in FIG. 2, namely, if the profile portion of the turbine moving blade has a shape such as to be reversed left to right relative to the turbine axial direction 31 as seen from the outer peripheral side in the radial direction, it is recommendable that the shape of the integral cover described in FIG. 2 is changed into a shape such as to be reversed left to right relative to the turbine axial direction, as well.

Figure 6:
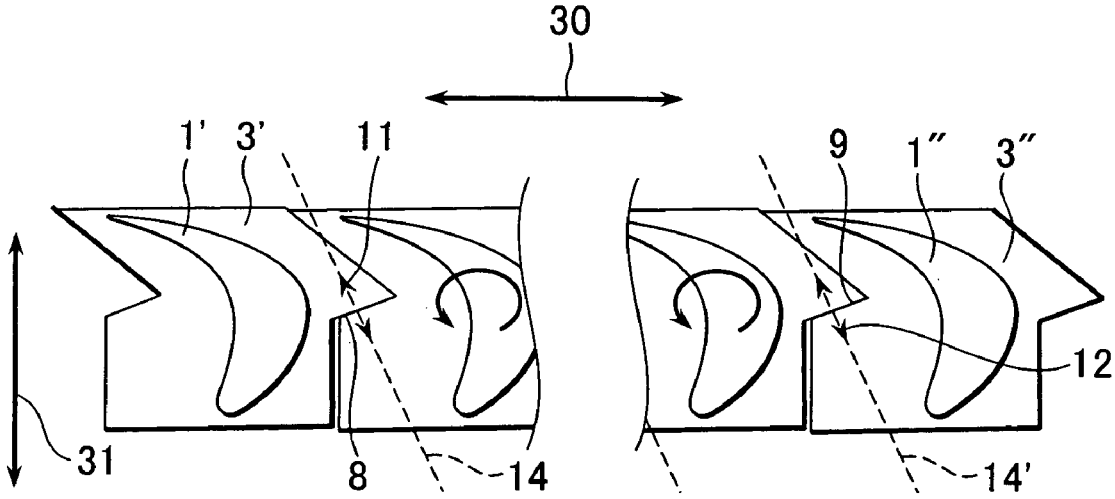
FIG. 6 is a plan view of a plurality of blade covers according to a second embodiment of the present invention, as seen from the radial direction.

FIG. 6 shows another embodiment according to the present invention. FIG. 6 is a plan view of integral covers as seen from the outer peripheral side in the radial direction. The integral cover 3 according to this embodiment has a suction sloped surface 8 and a pressure sloped surface 9 worked so as to have an inclination angle 7 that is a positive acute angle when measured in an anticlockwise direction from the circumferential direction 30. Here, the mutually adjacent blades are configured so that the suction sloped surface 8 of one of the blades and the pressure sloped surface 9 of the other of the blades contact each other.

The suction sloped surface 8 is set up so that the inward normal 14 passing through the mid point on the contact surface on the suction sloped surface 8 and orthogonally intersecting the sloped surface does not cross the blade profile on the suction blade side of the end blade 1' having a sloped surface, as seeing the integral cover 3 from the outer peripheral side in the radial direction. On the other hand, the pressure sloped surface 9 is set up so that the inward normal 14 passing through the mid point on the contact surface on the pressure sloped surface 9 and orthogonally intersecting the sloped surface does not cross the blade profile on the pressure blade side of the end blade 1" having a sloped surface.

More specifically, in this illustrated embodiment, the suction sloped surface 8 constituting a contact surface with the integral shroud portion of an adjacent blade is formed so that the inward normal 11 of an integral cover 3', on the perpendicular 14 passing through the mid point of the contact surface on the suction sloped surface 8 and orthogonally intersecting the suction sloped surface 8, does not cross the profile portion of the blade 1'. Also, the pressure sloped surface 9 pairing off with the suction sloped surface 8 is formed so that the inward normal 12 of an integral cover 3", on the perpendicular 14' passing through the mid point of the contact surface on the pressure sloped surface 9 and orthogonally intersecting the pressure sloped surface 9, does not cross the profile portion of the blade 1". This enables circumferential bending generated in the blade at the time of assembling, to be reduced, and prevents the occurrence of a large stress at the engagement portion between the disk groove 5 and the blade root hook 6, thereby allowing a turbine moving blade capable of being easily assembled and having high reliability to be provided.

If the rotational direction of turbine moving blade is opposite to that of the turbine moving blade described in FIG. 6, namely, if the profile portion of the turbine moving blade has a shape such as to be reversed left to right relative to the turbine axial direction 31 as seen from the outer peripheral side in the radial direction, it is recommended that the shape of the integral cover described in FIG. 6 is changed into a shape such as to be reversed left to right relative to the turbine axial direction, as well.

Figure 11:
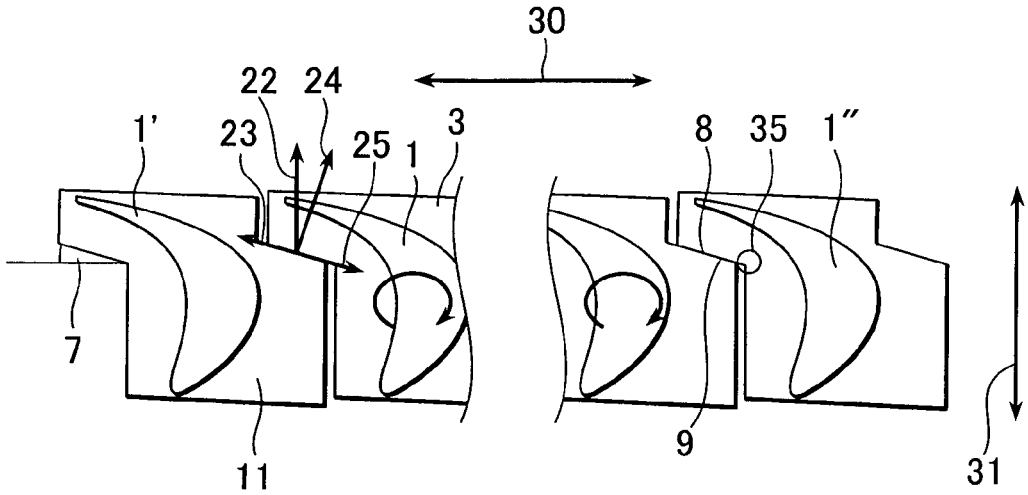
FIG. 11 is a plan view of a plurality of blade covers according to a third embodiment of the present invention, as seen from the radial direction.

A turbine blade structure according to another embodiment of the present invention will now be described with reference to FIG. 11. FIG. 11 is a plan view of the structure as seen from the radial direction. In this embodiment, the inclination angle 7 of the integral cover 3 is arranged so that an acute angle measured clockwise or anticlockwise from the circumferential direction 30 becomes in the range from 6 to 12 degrees, both inclusive. FIG. 11 shows the case where the inclination angle 7 clockwise measured is in the range from 6 to 12 degrees, both inclusive.

When assembling moving blades by sliding them along the circumferential direction one after another, in a state where a load in the circumferential direction has been caused to act on the cover portion, in the integral cover 3 of the end blade 1' located on the pressure side of an adjacent blade in the process of being assembled, the suction sloped surface 8 is given a forced displacement in the turbine axial direction, and an axial force 22 occurring in correspondence with an elastic restoring force of the blade acts on the integral cover 3. The axial force 22 is decomposed into a force component 23 in the sloped surface direction and a force component 24 in the direction vertical to the sloped surface. When a frictional force 25 represented by the force component 24 in the direction vertical to the sloped surface and the coefficient of static friction, exceeds the force component 23 in the sloped surface direction, circumferential bending of the blade can be inhibited even if the circumferential load which was caused to act on the blade at the time of assembling is released, thereby allowing the turbine blade to be easily assembled. The same goes for the end blade 1" located on the suction side of an adjacent blade in the process of being assembled. Such an angle is referred to as a "friction angle". Forming the integral cover so that the angle of the sloped surface becomes the friction angle or less, enables the circumferential bending generated in the blade at the time of assembling to be reduced, thereby preventing the occurrence of a large stress at the engagement portion between the disk groove 5 and blade root portion 6 at the time of assembling. This allows a turbine blade capable of being easily assembled and having high reliability to be provided.

Here, letting the static friction coefficient be 0.1, the friction angle becomes 6 degrees, and letting the static friction coefficient be 0.2, the friction angle becomes 12 degrees. The values 0.1 and 0.2 of the static friction are common as friction coefficients of a material. Because too small a sloped-surface angle enlarges stress concentration caused in a corner 35 of the integral cover, it is necessary to make the sloped surface angle as large as possible within the range of angle below the friction angle. Therefore, by making the angle of the sloped surface 6 to 12 degrees, the circumferential bending occurring in the blade can be made small, thereby allowing a turbine blade capable of being assembled and having high reliability to be provided.

Another embodiment according to the present invention is described with reference to FIGS. 7 and 8. Here, FIG. 7 is a schematic view showing a blade structure according to this embodiment, and FIG. 8 is an arrow view taken along the line A-A' in FIG. 7.

Regarding the turbine moving blade using the above-described integral cover 3, as shown in FIG. 5, only vertical forces 8 and 9 relative to the back and suction sloped surfaces act on the integral covers 3 of the end blades 1' and 1", respectively, located on the pressure side and suction side of the respective adjacent blades in the process of being assembled. As a consequence, the ends blades 1' and 1" are bending-deformed, and an restoring force of the blades works to thereby torsionally deforming the blades. In this case, the blade is subjected to bending and torsional deformation, and a reaction force against it occurs in the disk groove 5 provided on the outer periphery of the disk 4 and the blade root hook 6. Therefore, it follows that the turbine is rotated at a high speed with a high stress acted on at the time of assembling. This might cause strength problem.

Figure 7:
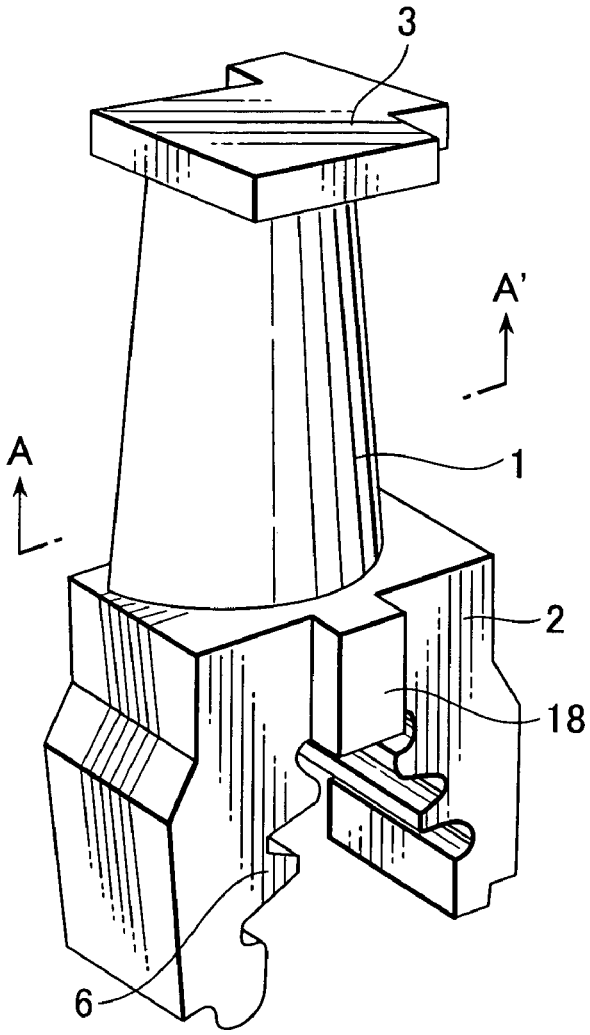
FIG. 7 is a perspective view of a blade structure according to a fourth embodiment of the present invention.
Figure 8:
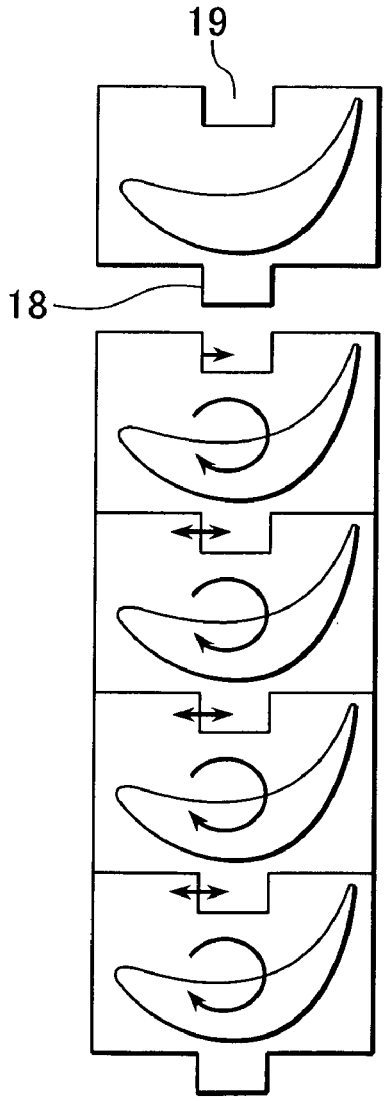
FIG. 8 is a plan view of a plurality of blade root portions according to a fourth embodiment of the present invention.

In contrast to this, in this embodiment, as shown in FIGS. 7 and 8, on the side surface of the blade suction side, there is provided a convex portion 18 projecting toward the suction side of the blade at a midway portion in the width in the axial direction and extending from the basal portion of the blade profile portion toward the inside in the radial direction, while, on the pressure side of the blade, there is provided a concave portion 19 recessing toward the pressure side of the blade and extending from the basal portion of the blade profile portion toward the inner peripheral side in the radial direction. Also, the convex portion and concave portion each have two surfaces parallel to the surface perpendicular to the turbine axial direction, whereby the convex and concave portions in adjacent blade roots are engaged with each other. This allows the disk groove 5 provided on the outer periphery of the disk 4 and the blade root hook 6 to be prevented from being subjected to an excessively high stress, thereby enabling a turbine blade capable of being easily assembled and having high reliability to be assembled.

Figure 9:
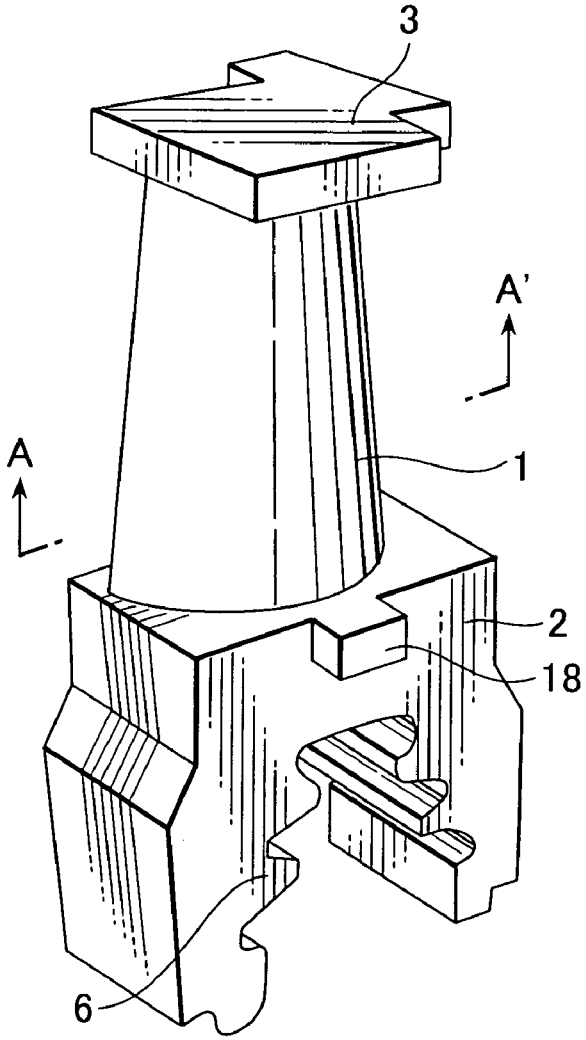
FIG. 9 is a perspective view of a blade structure according to a fifth embodiment of the present invention.
Figure 10:
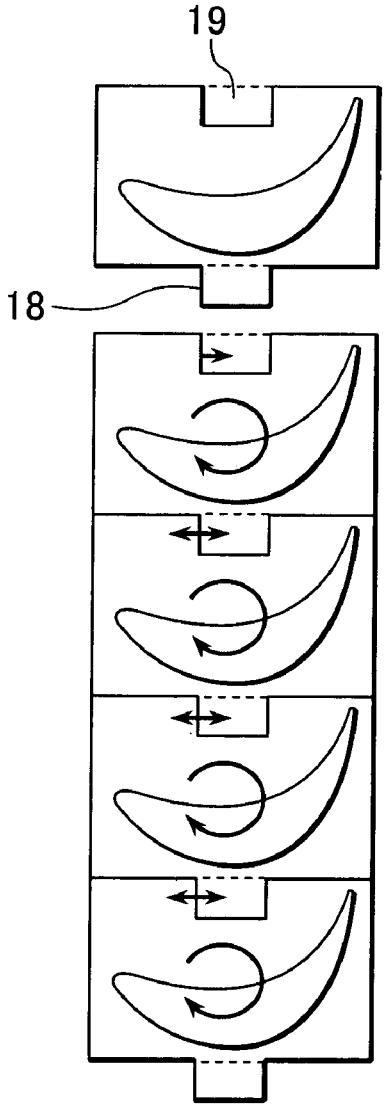
FIG. 10 is a plan view of a plurality of blade root portions according to a fifth embodiment of the present invention.

FIGS. 9 and 10 show another embodiment according to the present invention. FIG. 9 is a schematic view showing a blade structure according to this embodiment, and FIG. 10 is an arrow view taken along the line A-A' in FIG. 9. Here, a convex portion 18 and concave portion 19, respectively, provided on the suction side and pressure side may be structures that do not penetrate in the radial direction.

Figure 14:
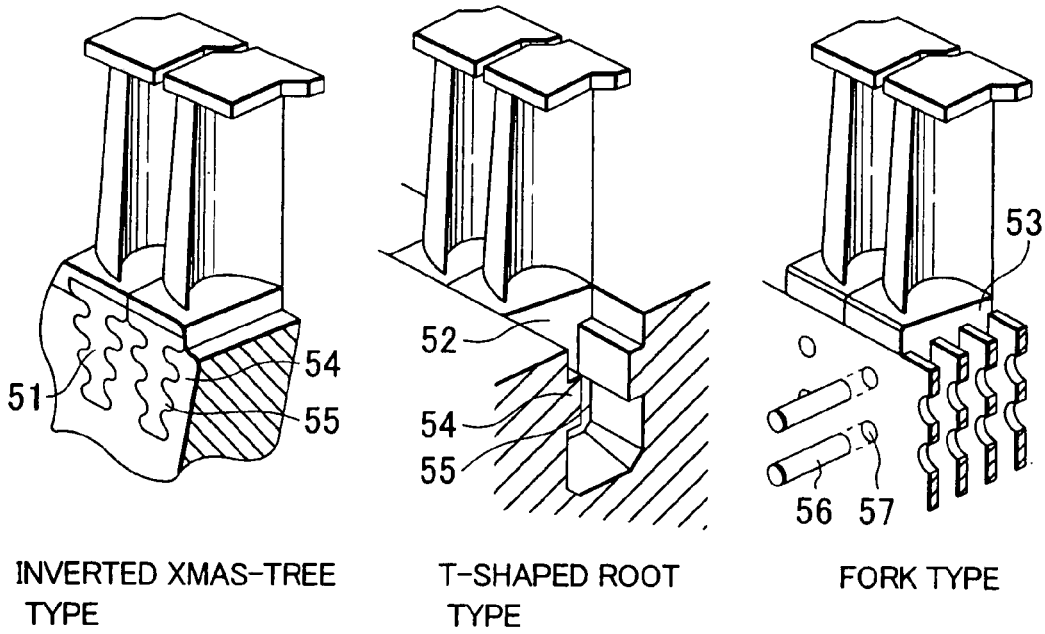
FIG. 14 is a perspective view of a blade structure according to a sixth embodiment of the present invention.

FIG. 14 shows other embodiments according the present invention. From FIG. 1 on, the blades having saddle-shaped blade root portions, which is of a peripheral direction insertion type, have been described. However, the present invention can also be applied to blades having an inverted Xmas-tree type blade root portion 51, a T-shaped root type blade root portion 52, and a fork type blade root portion 53. By suppressing circumferential direction bending of blade acting thereon at the time of assembling, the blades having the inverted Xmas-tree type blade root portion 51 and the T-shaped root type blade root portion 52 inhibit nonuniform contact between the disk groove 54 and the blade root hook 55, while the blade having the fork type blade root portion 53 inhibits nonuniform contact between fork pins 56 and fork pin-holes 57, thereby allowing a turbine structure capable of being easily assembled and having high reliability to be provided.

Figure 12:
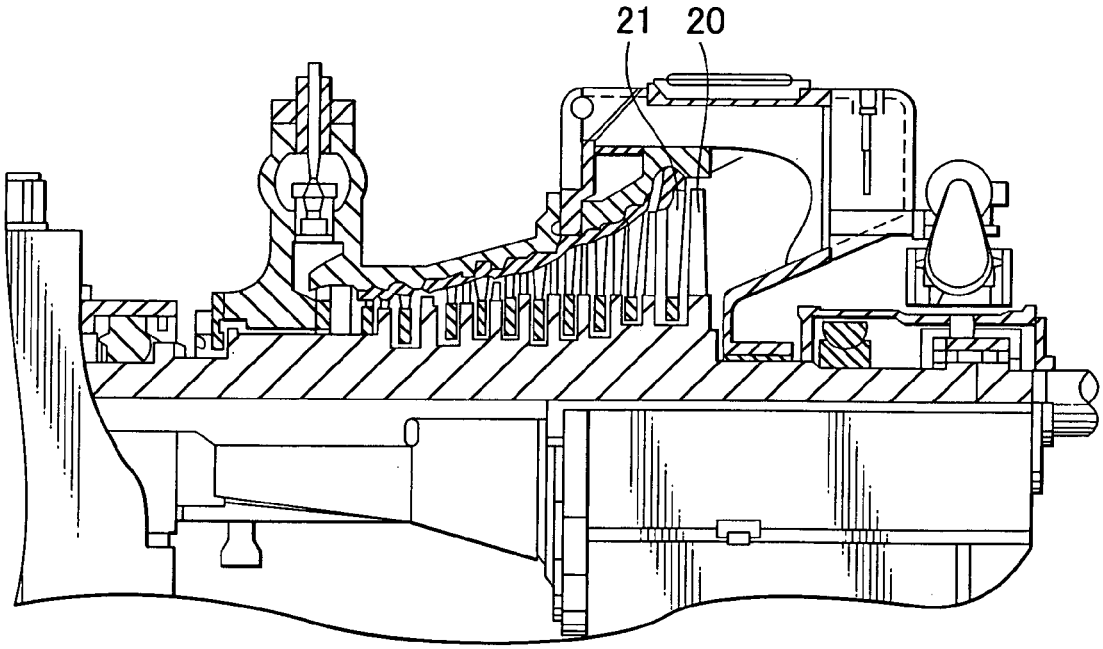
FIG. 12 is a plan view of a steam turbine using the blades and the blade structure according to the present invention.

FIG. 12 shows a part of a turbine structure example in the case where the above-described turbine moving blade is applied to a steam turbine. In this embodiment illustrated in FIG. 12, a turbine stage comprising the combined moving blades 20 and stationary blades 21 is formed. As shown in FIG. 12, by incorporating the above-described turbine moving blades into a plurality of turbine stages, it is possible to provide a turbine capable of easily assembled and being superior in reliability of the entire turbine.

Figure 13:
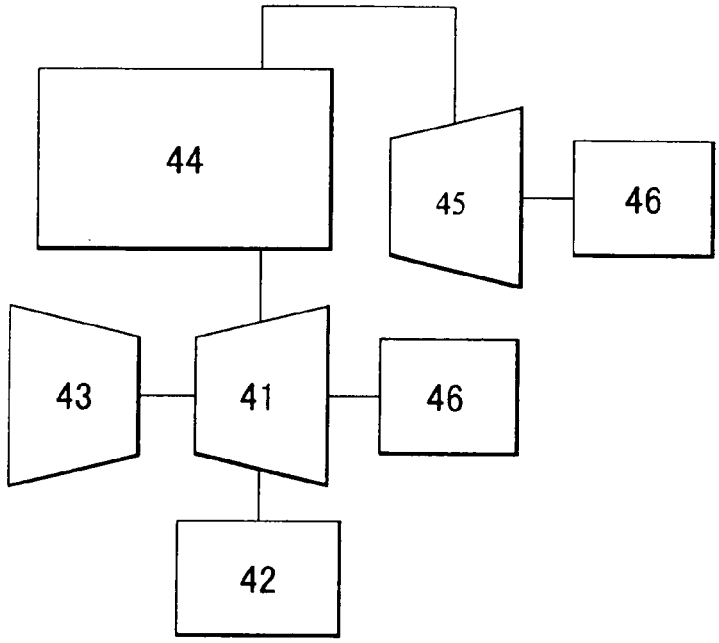
FIG. 13 is a block diagram of a combined cycle power generation plant using the blades and the blade structure according to the present invention.

Next, another embodiment according to the present invention is described with reference to FIG. 13. FIG. 13 shows a combined cycle power generation plant comprising a gas turbine 41, a combustor 42, a compressor 43, an exhaust heat recovery boiler 44, a steam turbine 45, and a power generator 46. The turbine moving blade according to the present invention can also be applied to the steam turbine of the combined cycle power generation plant, which includes these gas turbine; exhaust heat recovery boiler generating steam, serving as exhaust gas heat source from the gas turbine; steam turbine driven by steam generated by the exhaust heat recovery boiler.

In the illustrated combined cycle power generation plant, the steam turbine 45 has a plurality of turbine stages comprising moving blades and stationary blades as shown in FIG. 12, and as moving blades, those shown in FIG. 2 and FIGS. 5 to 11 are applicable to this plant. Thereby, a stable and a high-reliability combined cycle power generation plant can be provided.

As described above, adopting the above-described turbine moving blade makes it possible to maintain the connection state between mutually adjacent blades for all blades over the entire perimeter throughout the time periods of assembly and driving. Moreover, by suppressing nonuniform contact between the blade root hook and the disk groove at the time of assembling, it is possible to reduce stress caused at the engagement portion and provide a high-reliability turbine moving blade structure.

INDUSTRIAL APPLICABILITY

The turbine moving blade according to the present invention is used for a power generation area for generating electric power.

The invention claimed is:

1. A turbine moving blade comprising:

a blade portion extending from a basal portion to the tip of a moving blade;

a blade root portion formed at the basal portion of the blade portion and engaged with a corresponding disk groove of a turbine rotor on a one-by-one basis; and an integral cover formed at the tip of the blade portion integrally with the blade portion, wherein the integral cover has at least a pair of pressure and suction sloped surfaces inclined relative to a direction of a rotational axis of a turbine, and a pitch between the suction sloped surface and pressure sloped surface of the integral cover in a circumferential direction before assembly is larger than a geometric pitch, said geometric pitch being obtained by dividing the circumference at a radial position of the integral cover installation by the number of blades over the entire circumference after assembly, so that an elastic restoring force of the moving blade torsionally deformed at the time of installation of the moving blade by pressing the moving blade along the circumferential direction of the turbine for assembly, is restrained by bringing the suction sloped surface of the integral cover and a pressure sloped surface of an adjacent integral cover into contact; and wherein the integral cover is formed so that, as viewed from a radial direction, a normal of the suction sloped surface passing through a mid point on a contact surface on the suction sloped surface in a direction of the sloped surface does not cross the blade portion.

2. The turbine moving blade according to claim 1, wherein the integral cover is formed so that, as viewed form the radial direction, the normal of the suction sloped surface passing through the mid point on the contact surface on the suction sloped surface in the direction of the sloped surface and extended toward an inside of the suction sloped surface does not cross the blade portion.

3. The turbine moving blade according to claim 1, wherein the integral cover is formed so that, as viewed form the radial direction, the normal of the suction sloped surface passing through the mid point on the contact surface on the suction sloped surface in the direction of the sloped surface and extended toward an upstream side in a turbine axial direction toward an inside of the suction sloped surface does not cross the blade portion.

4. The turbine moving blade according to claim 1, wherein an angle of each of the suction sloped surface and the pressure sloped surface of the integral cover is arranged so that an acute angle measured from the circumferential direction becomes in the range from 6 to 12 degrees, both inclusive.

5. The turbine moving blade according to claim 1, wherein the blade root portion is configured so that a convex portion is formed on the side surface facing the blade root portion of one of the adjacent moving blades disposed along the circumferential direction of the disk groove, that a concave portion is formed on a side surface facing the blade root portion of the other of the adjacent moving blades disposed along the circumferential direction of the disk groove, and that each of the convex portions and a respective one of the concave portions in the blade root portions of a plurality of the adjacent moving blades are mutually engaged.

6. A turbine moving blade comprising:

a blade portion extending from a basal portion to a tip of a moving blade;

a blade root portion formed at the basal portion of the blade portion and engaged with a corresponding disk groove of a turbine rotor on a one-by-one basis; and an integral cover formed at the tip of the blade portion integrally with the blade portion, wherein the integral cover has at least a pair of pressure and suction sloped surfaces inclined relative to a direction of a rotational axis of a turbine, and a pitch between the suction sloped surface and pressure sloped surface of the integral cover in a circumferential direction before assembly is larger than a geometric pitch, said geometric pitch being obtained by dividing the circumference at a radial position of the integral cover installation by the number of blades over the entire circumference after assembly, so that an elastic restoring force of the moving blade torsionally deformed at the time of installation of the moving blade by pressing the moving blade along the circumferential direction of the turbine for assembly, is restrained by bringing the suction sloped surface of the integral cover and a pressure sloped surface of an adjacent integral cover into contact; and wherein the integral cover is formed so that, as viewed from a radial direction, a normal of the pressure sloped surface passing through a mid point on a contact surface on the pressure sloped surface in a direction of the sloped surface and extended toward an upstream side on an inside of the pressure sloped surface does not cross the blade portion.

7. A turbine comprising:

turbine stages, each formed by a blade cascade including a plurality of stationary blades and moving blades, the stationary and moving blades being arranged in a circumferential direction of a turbine rotor, wherein the moving blades each comprise:

a blade portion extending from a basal portion to a tip of the moving blade;

a blade root portion formed at the basal portion of the blade portion and engaged with a corresponding disk groove of a turbine rotor on a one-by-one basis; and an integral cover formed at the tip of the blade portion integrally with the blade portion, wherein:

the integral cover has at least a pair of pressure and suction sloped surfaces inclined relative to a direction of a rotational axis of a turbine, and a pitch between the suction sloped surface and pressure sloped surface of an integral cover in a circumferential direction before assembly is larger than a geometric pitch, said geometric pitch being obtained by dividing the circumference at a radial position of the integral cover installation by the number of blades over the entire circumference after assembly, so that an elastic restoring force of the moving blade torsionally deformed at the time of installation of the moving blade by pressing the moving blade along the circumferential direction of the turbine for assembly, is restrained by bringing the suction sloped surface of the integral cover and a pressure sloped surface of an adjacent integral cover into contact; and the integral cover is formed so that, as viewed from a radial direction, a normal of the suction sloped surface passing through a mid point on a contact surface on the suction sloped surface in a direction of the sloped surface and extended toward an inside of the suction sloped surface does not cross the blade portion.

8. A combined cycle power generation plant characterized by comprising:

a gas turbine:

an exhaust heat recovery boiler generating steam, serving as an exhaust gas heat source from the gas turbine; and a steam turbine driven by steam generated by the exhaust heat recovery boiler, wherein the steam turbine has turbine moving blades, each moving blade comprising:

a blade portion extending from a basal portion to a tip of the moving blade;

a blade root portion formed at the basal portion of the blade portion and engaged with a corresponding disk groove of a turbine rotor on a one-by-one basis; and an integral cover formed at the tip of the blade portion integrally with the blade portion, and wherein:

the integral cover has at least a pair of pressure and suction sloped surfaces inclined relative to a direction of a rotational axis of the turbine, and a pitch between the suction sloped surface and pressure sloped surface of the integral cover in the circumferential direction before assembly is larger than a geometric pitch, said geometric pitch being obtained by dividing the circumference at a radial position of the integral cover installation by the number of blades over the entire circumference after assembly, so that an elastic restoring force of the moving blade torsionally deformed at the time of installation of the moving blade by pressing the moving blade along the circumferential direction of the turbine for assembly, is restrained by bringing the suction sloped surface of the integral cover and a pressure sloped surface of an adjacent integral cover into contact; and the integral cover is formed so that, as viewed from a radial direction, a normal of the suction sloped surface passing through a mid point on a contact surface on the suction sloped surface in a direction of the sloped surface and extended toward an inside of the suction sloped surface does not cross the blade portion.

* * * * *